United States Patent [19]

Schumacher

[11] 4,187,695

[45] Feb. 12, 1980

[54] AIR-CONDITIONING SYSTEM HAVING RECIRCULATING AND FLOW-CONTROL MEANS

[75] Inventor: Ernest W. Schumacher, DeSoto, Tex.

[73] Assignee: Virginia Chemicals Inc., Portsmouth, Me.

[21] Appl. No.: 958,368

[22] Filed: Nov. 7, 1978

[51] Int. Cl.[2] ..... F25B 43/00

[52] U.S. Cl. ..... 62/503; 62/116; 62/192; 62/471; 62/500

[58] Field of Search ..... 62/116, 192, 471, 500, 62/503

[56] References Cited

U.S. PATENT DOCUMENTS

| | | | |
|---|---|---|---|
| 1,922,712 | 8/1933 | Randel | 62/116 |
| 1,972,704 | 9/1934 | Crosthwait, Jr. | 62/116 |
| 1,993,300 | 3/1935 | Randel | 62/116 |
| 2,088,609 | 8/1937 | Randel | 62/116 |
| 2,975,613 | 3/1961 | Heidorn | 62/192 |
| 3,379,030 | 4/1968 | Garner | 62/192 |
| 3,670,519 | 6/1972 | Newton | 62/116 |
| 3,777,509 | 12/1973 | Muench | 62/192 |
| 3,938,349 | 2/1976 | Ueno | 62/192 |

*Primary Examiner*—Ronald C. Capossela
*Attorney, Agent, or Firm*—Depaoli & O'Brien

[57] ABSTRACT

In a refrigerant system having a liquid trapping suction accumulator between the evaporator exit and the compressor entrance and a very short bore capillary as an expansion tube to replace the thermostatic expansion valve, a recirculating ejector is added to recirculate any liquid that may be trapped by the accumulator back into the evaporator inlet where it can be used to provide desired refrigerating effect without requiring additional work in the compressor. The expansion tube is positioned so that it functions as the primary nozzle of the ejector. Thus the high-pressure liquid refrigerant being expanded through the expansion tube becomes the prime mover that is needed to drive the liquid from the accumulator into the evaporator. Because the high-pressure liquid refrigerant must be expanded to the relatively lower evaporator pressure in any vapor cycle refrigeration system, the recirculating function is accomplished without using additional energy or penalizing system capacity. Additionally, a heat exchanger is provided to heat the liquid/vapor/oil mixture leaving the accumulator and to cool the high-pressure liquid feeding the ejector primary nozzle, thus thermodynamically compensating for the small amount of compressor work associated with liquid in the suction vapor by sub-cooling the high-pressure liquid en route to the evaporator.

12 Claims, 3 Drawing Figures

20
Insulation 23
Dessicant bag 24
Liquid refrigerant 22
Strainer 28
Oil return orifice 29
Vapor
Suction line 33
High pressure liquid
Condenser
Compressor
37
Deflector 26
35
27
Accumulator
21
25
31
45
57
59
58
55
53 Expansion tube
43
47
51
Recirculating ejector 40
EVAPORATOR

AIR-CONDITIONING SYSTEM HAVING RECIRCULATING AND FLOW-CONTROL MEANS

BACKGROUND OF THE INVENTION

1. Field of the Invention

This invention relates to refrigeration and air conditioning and particularly relates to increasing the thermodynamic efficiency of vapor compression systems used for air conditioning of automotive passenger compartments. It especially relates to automatic control during bypass of liquid from the compressor and to combining of fluids having diverse temperatures.

2. Review of the Prior Art

The trend in automotive air conditioning systems is to replace the thermostatic expansion valve with a less-responsive liquid-control device, called an "expansion tube," which in essence is a short-bore capillary approaching an orifice. The primary reason for this substitution is that a thermostatic expansion valve is not completely dependable and is relatively expensive. However, the expansion tube is not responsive enough to prevent over-feeding under all operating conditions and is certainly much less responsive to variations in system operating conditions than is a thermostatic expansion valve. Therefore, at many operating conditions the expansion tub over-feeds the evaporator with liquid refrigerant.

To prevent this excess liquid from reaching the compressor in damaging quantities, a liquid trapping suction accumulator is more necessary than usual and is used, as is customary, to catch and meter the liquid return at a rate that will not damage the compressor. With this arrangement, all of the unevaporated liquid entering the accumulator must eventually pass through the compressor, either in the form of refrigerant vapor created by the transfer of heat from the engine compartment through the wall of the accumulator, or in the form of atomized liquid droplets that are metered into the suction vapor flow going to the compressor via the accumulator. The result of this process is that the mass flow through the compressor is greater than the mass flow required to provide the useful refrigerating effect in the evaporator. This additional mass flow rate requires the compressor to do additional work and therefore to consume energy beyond that required to provide the desired cooling capacity.

The performance of the expansion tube is based primarily on two factors. One is the pressure differential from inlet to outlet of the tube, so that as the pressure differential increases, the mass flow rate through the tube increases. The other factor is the condition of the high-pressure liquid entering the tube with respect to the amount of sub-cooling in the high-pressure liquid. In other words, the amount of sub-cooling is measured by how much the temperature of the liquid is reduced below its saturation temperature. The way that sub-cooling affects the flow rate through the expansion tube is that the greater the sub-cooling in the entering liquid, the greater is the flow rate through the expansion tube so that the two factors, the pressure differential and the sub-cooling, then combine to give a finite flow rate of liquid through the expansion tube.

The process by which sub-cooling affects the flow rate in the expansion tube is that a pressure gradient exists across the expansion tube and as the high-pressure sub-cooled liquid enters the expansion tube, the pressure of that liquid begins to follow the pressure gradient line and reduces to the point of saturation. At the point of saturation, any further reduction of pressure which does occur causes the formation of vapor from the saturated liquid which then causes the balance of the tube length from that point on to perform as though it were handling vapor rather than liquid, thus causing the tube to choke and therefore giving a throttling effect and reducing the mass flow rate through the tube. Now, the way the expansion tube displays the control characteristics in the refrigeration system that is unique to refrigeration closed systems is that the amount of sub-cooling in the entering liquid varies with evaporator loading because of refrigerant charge distribution in the system. For example, at low-load conditions, one tends to have more of the refrigerant charge in the evaporator and hence less in the condensor. Therefore, the liquid entering the expansion tube is not sub-cooled as much; this situation causes the "bubble void" (defining the point where vapor first forms) to move upstream and causes more of the tube length to operate under vapor-flow conditions, thereby causing an increased throttling effect to occure that reduces the total flow rate. Conversely, when the evaporator load is high, the evaporator tends to hold less of the refrigerant charge, moving more of it to the condensor where it is allowed to sub-cool more. The increased sub-cooling in the entering liquid causes the bubble point or point of saturation to move downstream in the expansion tube and then less of the tube length is operating under vapor flow conditions. Thus the throttling effect is relaxed.

Because the expansion tube performs in this manner in a normal refrigerating system, one always has two-phase flow exiting the expansion tube. Because two-phase flow is difficult to predict, especially in transient conditions such as those existing in nozzled exits, it is therefore very difficult to predict what the induced rate of flow through the side connection of the ejector will be with respect to the primary flow rate through the expansion tube. A range of induction ratios does in fact exist, and the only way to establish what that range is absolutely is by measurement.

The inside bore diameter of the expansion tube can varied from 0.030 inch to 0.125 inch, and the length of the expansion tube can be varied from one inch to four inches. A designer normally tends to ascertain optimum diameter and length for a specific fluid and refrigeration system and thereafter remain as close as possible thereto.

United States patents in which the motive energy in the fluid is used to compress the fluid within the refrigeration cycle include the following: U.S. Pat. Nos. 1,922,712; 1,972,704, 1,993,300; 2,088,609; and 3,670,519. Other United States patents which relate to controlling or responding to the condition of the lubricant are the following: U.S. Pat. Nos. 2,975,613; 3,379,030; 3,777,509; and 3,938,349.

These patents in combination indicate that the high pressure fluid can be used to entrain another fluid and to inject it into the evaporator and further show that the art has been aware of the need for circulating the oil to the compressor. However, neither singly or in combination has the prior art taught that liquid in the liquid trapping suction accumulator could be fed to the evaporator without a separate pump or that the liquid and/or vapor in the accumulator could be used for sub-cooling the fluid entering the evaporator while being warmed for feeding to the compressor.

SUMMARY OF THE INVENTION

It is accordingly an object of this invention to provide a pump means that utilizes available power sources to transfer liquid directly from the accumulator to the evaporator without imposing an additional load on the compressor.

It is also an object to provide a means to transfer heat from the heated liquid, moving from the condenser to the evaporator, into the cooled vapor, moving from the accumulator to the compressor.

It is further an object to provide a means for similarly transferring heat to a fraction of the liquid in the accumulator that is to be used for supplying oil to the compressor.

It is further an object to provide a flow-control means for controlling the rate of flow of liquid from the condensor to the evaporator in accordance with the proportionate amount of liquid distributed between the condensor and the evaporator.

The invention therefore comprises the addition of a recirculating ejector which pulls any desired fraction of the liquid trapped within the accumulator into the expansion tube, so that the ejector recirculates any liquid that may be trapped by the accumulator back into the evaporator inlet where it can be used to provide desired refrigerating effect without the need of expending additional work required in passing it through the compressor.

A particular embodiment of this concept comprises the positioning of the expansion tube so that it functions as the primary nozzle of the ejector, whereby the high-pressure liquid refrigerant being expanded through the expansion tube becomes the prime mover that is required to drive the liquid being recirculated through the evaporator and from the accumulator.

As a further embodiment of the invention, a minor portion of the liquid leaving the accumulator, in addition to that recirculating directly to the ejector, feeds through a heat exchanger and vents to the compressor so that there is a continuous flow of oil in the system to the compressor. With this arrangement, the liquid/-vapor/oil mixture leaving the accumulator enters the heat exchanger where it is brought into heat-exchange relationship with the warm high-pressure liquid which feeds the ejector primary nozzle. The heat exchange within the heat exchanger causes the liquid portion of the compressor suction flow to evaporate while at the same time cooling the warm high-pressure liquid leaving the condenser. This sub-cooling increases the refrigerating effect that is available in a unit mass of refrigerant. The transfer of heat from the warm liquid to the cool suction mixture thermodynamically compensates for the small amount of compressor work that is associated with liquid in a suction vapor by sub-cooling the high-pressure liquid en route to the evaporator.

DESCRIPTION OF THE PREFERRED EMBODIMENTS

Figure 1:
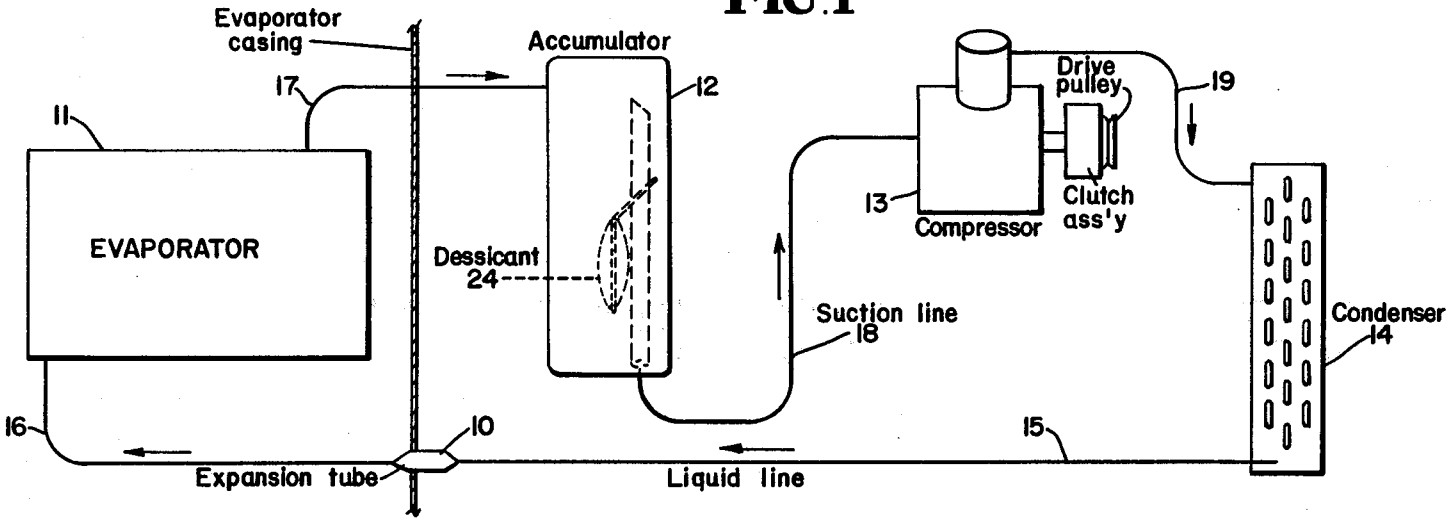
FIG. 1 is a schematic drawing of a refrigerant system which the automotive industry is beginning to employ for cooling and dehumidifying the passenger compartments of automobiles and trucks at the present time.

Referring to FIG. 1 which shows in schematic form a typical automotive air conditioning system with cycling clutch and an expansion tube, instead of a thermostatic expansion valve, high-pressure liquid in line 15 passes through expansion tube 10 and moves as low-pressure liquid/vapor to evaporator 11 where evaporative cooling occurs. Low-pressure vapor and a variable amount of liquid then pass through line 17 to accumulator 12. In the accumulator, unevaporated liquid is stored until needed. Vapor passes through the standpipe within the accumulator through suction line 18 to compressor 13 wherein the vapor is changed to a warm high-pressure state and passes through line 19 to condenser 14 wherein heat is removed to change the vapor to high-pressure liquid. It is this prior art system which is the subject for the improvement of this invention.

Figure 2:
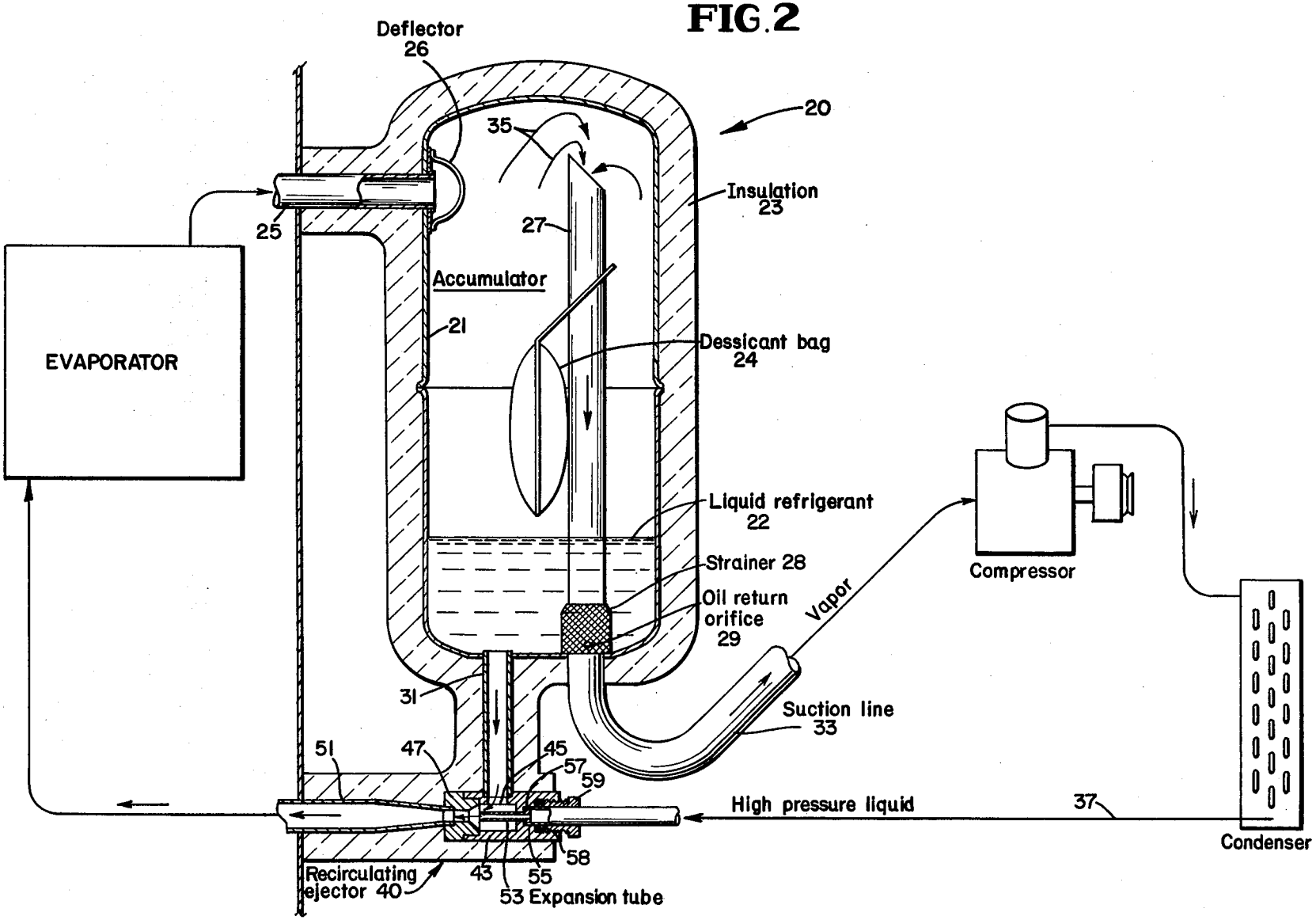
FIG. 2 is a schematic drawing showing an improvement to the system described in FIG. 1 in which the expansion tube is positioned so that it functions as the primary nozzle of a recirculating ejector for recirculating any liquid trapped by the accumulator back into the evaporator inlet.

As shown in FIG. 2, an accumulator 20 is connected to a recirculating ejector 40 having an expansion tube 53 of the prior art as a part thereof. Vapor and liquid from the evaporator pass through inlet line 25 and deflector 26 to attain tangential entry around the walls 21 of accumulator 20. Vapor 35 enters the top of standpipe 27 and passes through vapor line 33 to the compressor. Drops and slugs of liquid in line 25 tend to stick to walls 21 and spiral downwardly to pool 22 of liquid refrigerant in the bottom thereof. A portion of this liquid refrigerant enters oil return orifice 29, after passing through strainer 28, and is entrained by vapor 35 passing therethrough in order to ensure that the compressor has always a sufficient supply of oil, as is well known in the art. Desiccant in desiccant bag 24 absorbs any moisture that may be in the system.

It is, however, the pool 22 of liquid refrigerant to which this invention is directed. Instead of allowing this refrigerant to be gradually removed through oil return orifice 29 or to be evaporated by heat that is absorbed from the surrounding air or from the engine of the automobile, it is the purpose of this invention to recycle this liquid refrigerant back to the evaporator where it can do its job of providing refrigerating effects rather than forcing it to go to the compressor in either droplet or vapor form and thereby forcing the compressor to do additional work on it when there is no need to do so. Another way of expressing the situation is to state that the liquid refrigerant has "slopped over" through the evaporator without having had an opportunity to do its job, so that this invention provides a direct means whereby that liquid can be given a second chance in the evaporator, rather than forcing the compressor in the system to do more work on it before that opportunity can be given again.

Accordingly, an opening in the bottom of accumulator 20 is fitted with a connecting line 31 which is attached to a side entrance to injector cavity 45 in a shroud 43 of recirculating ejector 40. An ejector block 47 is attached to the downstream end of shroud 43 and a diverging nozzle 51 is attached thereto in flow alignment with expansion tube 53 which is centrally disposed within injector cavity 45. Expansion tube 53 is sealably attached to a collar 55 and is held in place within shroud 43 by an O-ring 57, a stop washer 58, and a retaining nut 59 into which high-pressure liquid delivery line 37 is closely fitted.

Because this recirculating ejector 40 can be designed so that the direct weight ratio of secondary flow through line 31 to primary flow through expansion tube 53 can be anywhere from 0.25/1.0 to 2.0/1.0, it is possible to provide that the pool 22 of liquid refrigerant can be very rapidly emptied or can be repeatedly passed through the evaporator, when the system is operating at a high flow rate, by choosing a direct ratio that is close to 2.0/1.0. Such a high direct ratio has the advantage of providing an abundance of liquid refrigerant in very hot climatic conditions when very rapid cooling can be highly desirable. If the system is designed for a much lower direct ratio, such as 0.35/1.0, pool 22 of liquid refrigerant is emptied much more slowly but is nevertheless available for reasonably rapid cooling but need not be recirculated through the evaporator with as much frequency. Such a ratio is generally suitable for most conditions when ambient temperatures are not unbearable to occupants of an automotive passenger compartment.

Figure 3:
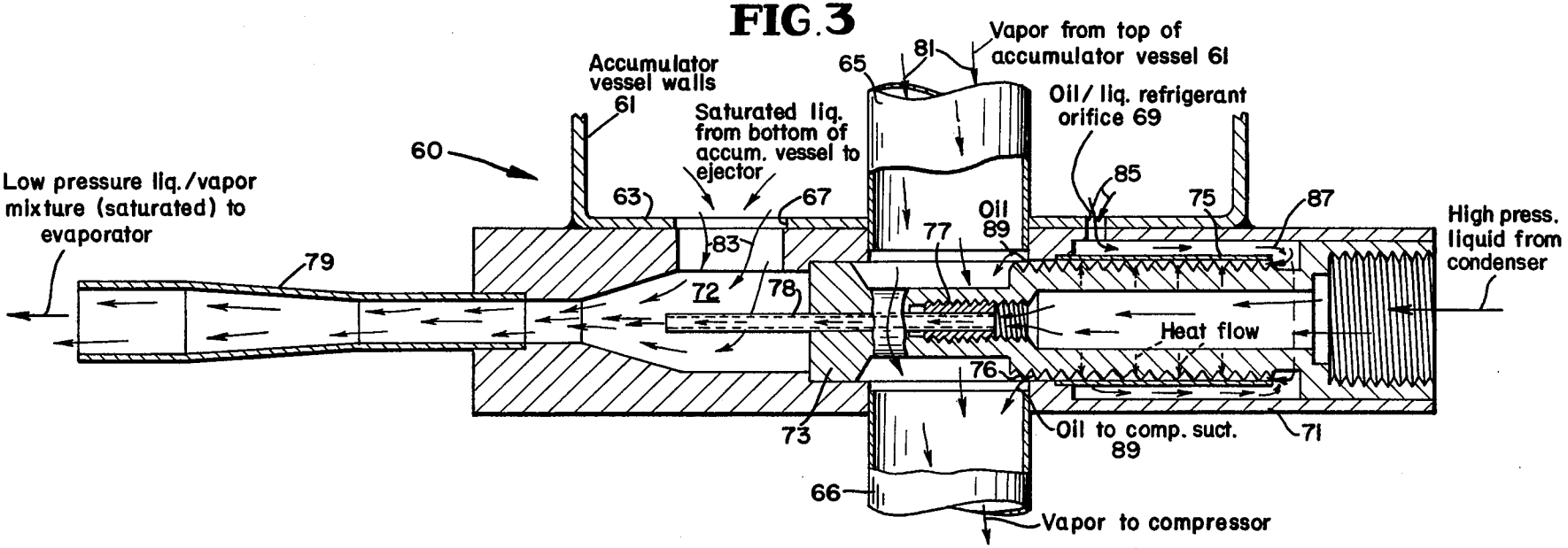
FIG. 3 is a detailed cross-sectional elevation of the recirculating ejector of FIG. 2 in which the expansion tube is within a heat exchanger for vapor moving through the standpipe and for a small portion of the liquid within the accumulator, the heat exchanger also being within the recirculating ejector which is sealably attached to the bottom of the liquid trapping suction accumulator of the refrigerant system.

The integral accumulator/recirculator embodiment 60 which is shown in FIG. 3 comprises a heat exchanger that is integrally constructed with the expansion tube and ejector of FIG. 2 and which comprises mating the ejector block into a groove stamped in the bottom of the accumulator and then sealably attaching the accumulator to the ejector block by brazing all around the adjoining edges.

In this embodiment shown in FIG. 3, walls 61 of the accumulator rest upon ejector block 71 and are brazed thereto, and bottom 63 of the accumulator is adjacent to the side of the ejector block 71. An opening having sides 67 in accumulator bottom 63 coincides with the side entrance in the ejector block 71 and gives access to cavity 72 therein. Diverging nozzle 79 is attached to ejector block 71 and is in flow connection with cavity 72 at its narrow end and with the evaporator at its wider end. Standpipe 65 of the accumulator is connected to another opening in ejector block 71 and is in flow connection with a circumannular channel surrounding ejector heat exchanger 73 which is coaxially disposed within ejector block 71 and sweated into integral contact therewith. Heat exchanger 73 has a coaxially disposed opening therein into which expansion tube 78 is tightly but removably fitted. Expansion tube 78 is sealably attached, as by brazing, to a set screw 77 (functioning as an expansion tube retainer) which is threaded into the threaded opening in ejector heat exchanger 73.

Still another opening 69 is provided in bottom 63 of the accumulator for passage of oil/liquid refrigerant into a correspondingly disposed return orifice in ejector block 71. A small portion 85 of the liquid refrigerant in the accumulator, such as 2% to 5%, flows through opening 69 and the orifice and then through a cylindrical passage as flow 87, countercurrently to flow from the condenser, and next reverses to enter a helical passage formed by coarse threads 76 to exit as oil return 89. During this flow through the helical passage, most of the liquid refrigerant in the oil/liquid refrigerant 85 evaporates, but the oil remains as droplets to be entrained by vapor 81 entering standpipe 65 and passing out through exit line 66 to the compressor.

When vapor 81 moving through standpipe 65 enters the annular passage around heat exchanger 73, there is a venturi effect which lowers the pressure and induces flow 89 through the helical passage. However, additional baffling can be added to lower the pressure at the exit of the helical passage formed by coarse threads 76 in order to further induce such flow therethrough.

The cooling effect provided by heat exchange from the oil/liquid refrigerant 85 and the vapor 81 causes additional sub-cooling of liquid from the condenser so that the bubble void is moved farther to the left as seen in FIG. 3, thus reducing throttling effects by vapor and causing a larger proportion of expansion tube 78 to perform in liquid mode and at a faster flow rate. This characteristic can be compensated for by the designer as to the length of expansion tube 78 or as to its bore size, for example. Alternatively, the designer can utilize this increased flow rate to provide dramatically fast cooling under very hot and uncomfortable conditions for passengers in automotive compartments.

The annular space surrounding heat exchanger 73 and set screw 77 is not shown in FIG. 3 as being provided with fins for more efficient heat transfer between vapor 81 and liquid from the condenser. However, such fins can readily be provided, as well as other heat transfer devices that are known in the art. In general, the amount of heat transfer and the point at which maximum heat transfer is desired is a function of the point at which the designer wishes the bubble void to occur and the length within the expansion tube through which he wants it to move under an expected range of ambient conditions.

Because it will be readily apparent to those skilled in the art that innumerable variations, modifications, applications, and extensions of the examples and principles hereinbefore set forth can be made without departing from the spirit and the scope of the invention, what is herein defined as such scope and is desired to be protected should be measured, and the invention should be limited, only by the following claims.

What is claimed is:

1. In an air conditioning apparatus of the vapor compression type, comprising: an evaporator, an accumulator, a compressor, a condenser, and an expansion tube through which high-pressure liquid is expanded into said evaporator, the improvement comprising, in combination with said expansion tube and said accumulator:

A. an ejector block having a first side entrance, a longitudinal opening in which said expansion tube is coaxially disposed, and an inner cavity into which said expansion tube empties and with which said side entrance is connected;

B. a connection between said side entrance and an opening in the bottom of said accumulator; and C. a diverging tube which is connected at its narrow end to said inner cavity and at its wide end to said evaporator, whereby said ejector block, said expansion tube, said side entrance, and said diverging tube form, in combination, an ejector means for ejecting liquid from said accumulator and for injecting said accumulated liquid, mixed with said expanded high-pressure liquid, into said evaporator.

2. The improvement in the air conditioning apparatus of claim 1 wherein the expansion tube is removably fitted within said ejector block.

3. The improvement in the air conditioning apparatus of claim 1 wherein the flow rate of said high-pressure liquid through said expansion tube, as the primary flow rate into said cavity, varies from four pounds to one-half pound per pound of flow of said accumulated liquid as the secondary flow rate into said cavity.

4. The improvement in the air conditioning apparatus of claim 1 wherein said accumulator and said ejector block are adjacently disposed and sealably attached to each other.

5. The improvement in the air conditioning apparatus of claim 4 wherein said first side entrance and said opening in said bottom of the accumulator are adjacent.

6. The improvement in the air conditioning apparatus of claim 1 wherein said accumulator has a standpipe therein and said is fitted into a second side entrance into said ejector block.

7. The improvement in the air conditioning apparatus of claim 6 wherein said second side entrance is connected to a circumannular passage surrounding first a heat exchange member within which said expansion tube is fitted.

8. The improvement in the air conditioning apparatus of claim 7 wherein said first heat exchange member is fitted with means for increasing heat transfer between vapor passing through said standpipe and high-pressure liquid passing through said expansion tube.

9. The improvement in the air conditioning apparatus of claim 8 wherein a second opening in said bottom of said accumulator is aligned with an orifice in the side of said ejector block.

10. The improvement in the air conditioning apparatus of claim 9 which further comprises a second heat exchange member which has a threaded portion within a tightly enclosing outer sleeve, the outer surface of said outer sleeve being radially spaced from the inner surface of said ejector block to form a cylindrical passage in flow connection with said orifice.

11. The improvement in the air conditioning apparatus of claim 10 wherein said sleeve is shorter than said second heat exchange member, whereby said cylindrical passage is in flow connection with a helical passage formed between said threads and the inner surface of said sleeve.

12. The improvement in the air conditioning apparatus of claim 11 wherein said helical passage provides a flow path for oil to reach said circumannular passage, while heat exchanging with said high-pressure liquid, said oil being entrained by said vapor and returned to said compressor.

* * * * *